United States Patent [19]

MÅnsson et al.

[11] Patent Number: 4,860,535

[45] Date of Patent: Aug. 29, 1989

[54] POWER PLANT FOR BURNING A FUEL AT HIGH PRESSURE AND A GAS TURBINE DRIVEN BY THE COMBUSTION GASES

[75] Inventors: Martin MÅnsson; Ragnar Torstenfelt, both of Finspong, Sweden

[73] Assignee: ABB Stal AB, Sweden

[21] Appl. No.: 166,129

[22] Filed: Mar. 9, 1988

[30] Foreign Application Priority Data

Mar. 9, 1987 [SE] Sweden ..... 8700960

[51] Int. Cl.[4] ..... F02C 3/26

[52] U.S. Cl. ..... 60/39.464; 110/263; 137/599

[58] Field of Search ..... 60/39.12, 39.464; 110/244, 245, 263, 266; 122/4.10; 431/170; 137/599

[56] References Cited

U.S. PATENT DOCUMENTS

| | | | |
|---|---|---|---|
| 1,934,713 | 11/1933 | Hughes | 137/599 |
| 3,937,248 | 2/1976 | Hutton | 137/599 |
| 4,487,275 | 2/1975 | Kreij . | |
| 4,498,286 | 2/1975 | Brannstrom et al. . | |
| 4,744,212 | 5/1988 | Andersson et al. | 60/39.46 X |

*Primary Examiner*—Louis J. Casaregola
*Attorney, Agent, or Firm*—Pollock, Vande Sande & Priddy

[57] ABSTRACT

A power plant for burning a fuel at a pressure exceeding atmospheric pressure, in particular a PFBC power plant with a bed vessel enclosed in a pressure vessel, includes a plurality of valves in a hot gas pipe between the bed vessel and a turbine, and an air duct between a compressor and the bed vessel, and in a short-circuit connection between the ducts which are constructed as a single valve unit located in a valve housing. Arranged centrally in the valve housing is a cylinder providing passage for gas to the turbine and an annular channel is formed between the valve housing and the cylinder for compressed air from the compressor. At least one valve is provided in the cylinder and the channel includes a plurality of valves arranged in parallel. Between the annular channel and the cylinder a short circuit connection is provided having a plurality of valves. The valvs in the air duct and the valves in the short circuit connection have valve discs arranged on a common spindle. The valve in the air duct can function as a non-return valve should the operating device of one of the valves fail to operate.

6 Claims, 2 Drawing Sheets

POWER PLANT FOR BURNING A FUEL AT HIGH PRESSURE AND A GAS TURBINE DRIVEN BY THE COMBUSTION GASES

TECHNICAL FIELD

The invention relates to a power plant comprising a combustion chamber for burning fuel at a pressure exceeding atmospheric pressure, a gas turbine driven by the generated combustion gases, a compressor driven by the gas turbine for compression of combustion air and a second load object, usually a generator connected to a power grid. It is primarily intended for a PFBC power plant for burning coal or other fuel in a fluidized bed of particle material containing sulphur absorber. PFBC stands for Pressurized Fluidized Bed Combustion. The combustion chamber with the fluidized bed is generally located in a bed vessel surrounded by a pressure vessel. The area between pressure vessel and bed bessel than contains compressed combustion air.

BACKGROUND ART

The great energy content in the fluidized bed ina PFBC power plant entails particular problems at a load drop and tripping of the gas turbine. The supply of energy from the combustion chamber must be rapidly cut to prevent the speed of the turbine from increasing to a dangerous level. Shut-down valves are provided in the hot-gas pipe between bed vessel and turbine and in the air duct between compressor and bed vessel or a pressure vessel surrounding the bed vessel. The plant also includes a by-pass conduit or short-circuit pipe between the hot-gas pipe and the air duct. This by-pass pipe contains a valve which, when the gas turbine trips, opens to provide direct communication between compressor and turbine. U.S. patent application Ser. No. 007,226, filed Jan. 27, 1987 describes a PFBC power plant of this type, and how such a plant can be controlled in the event of the gas turbine tripping at a load drop.

SUMMARY OF THE INVENTION

According to the present invention at least one valve in the hot-gas pipe between bed vessel and turbine, a plurality of valves arranged in parallel in the combustion-air pipe between compressor and bed vessel and a plurality of valves arranged in parallel in the short-circuit connection between the two previous pipes, form a single valve unit.

The valve unit may comprise a valve housing, a cylinder located centrally therein and forming passage for the hot combustion gases from the bed vessel. The cylinder may contain one or more valves. Between the cylinder and the turbine house may be an annular channel or a plurality of channels, forming a passage for compressed air from the compressor. In one embodiment with an annular channel a plurality of shut-off valves are arranged in parallel. In an embodiment with a plurality of parallel channels, a valve is suitably provided in each channel, but there may be more than one valve in each channel. Furthermore, a plurality of connections with valves are provided between the air duct(s) and the passage through the cylinder. The valve discs in the valves in the air duct(s) and the valve disc in the valves in the connection between the air duct(s) and the cylinder are arranged on a common operating rod and are operated by one and the same control means. To close the valve in the air duct even if these operating devices are out of function, the valve disc in the valve in the air duct is arranged axially displaceable on the operating rod and is held in its normal position by a spring. If an operating member does not function, the pressure on the upstream side of the valve will drop, whereas the pressure on its downstream side will remain substantially unchanged. Compressed combustion air in the air duct and pressure vessel will thus endeavour to flow back through the valve. The pressure difference between the two sides of the valve disc produce a force which exceeds the spring force and effects displacement of the valve disc to closed position against the valve seat. The valve in the combustion-air channel thus functions as a non-return valve in the even of its control device malfunctioning. This increases the reliability of the valve unit.

DESCRIPTION OF A PREFERRED EMBODIMENT

Figure 1:
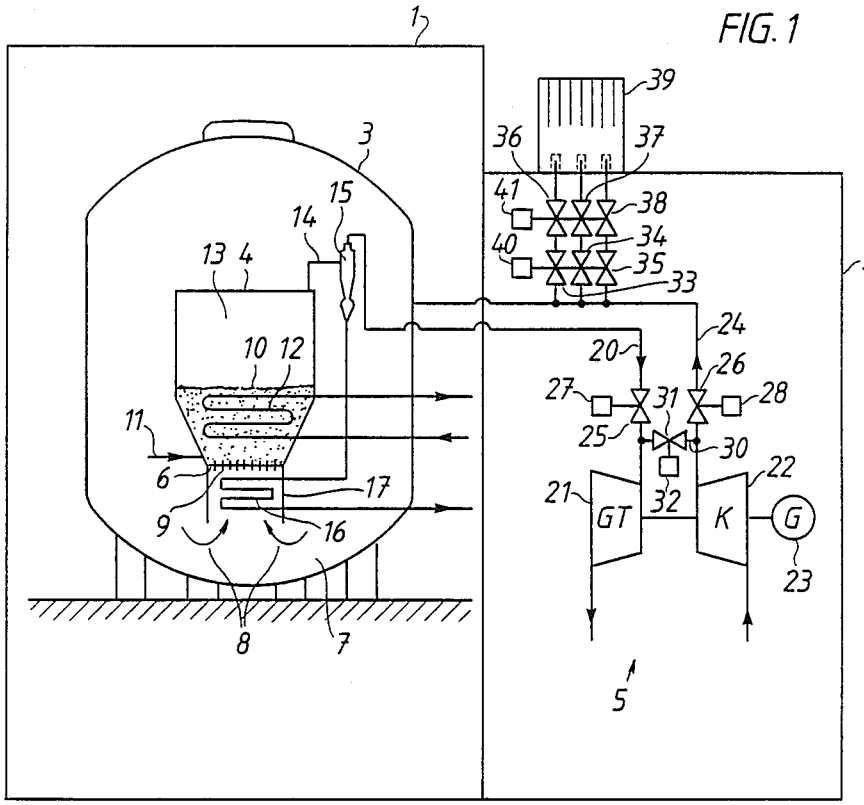
FIG. 1 schematically a PFBC power plant in which the present invention can advantageously be utilized.
Figure 2:
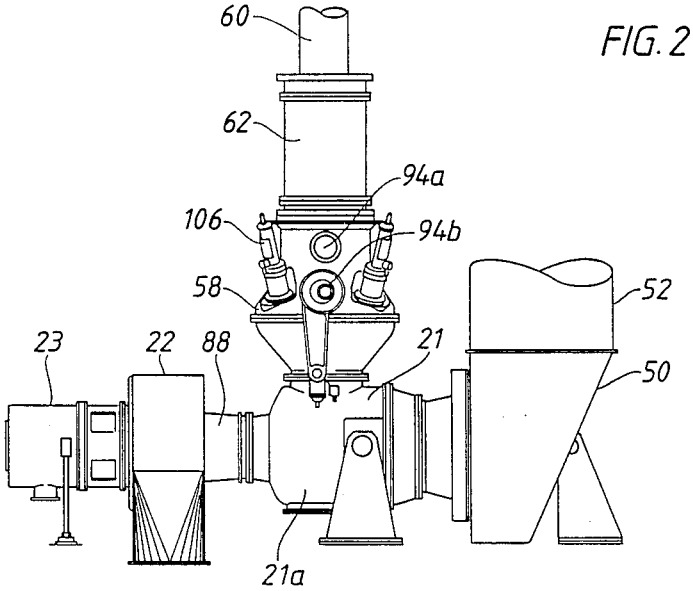
FIG. 2 is a view of a gas-turbine/compressor unit witha valve means according to the invention.
Figure 3:
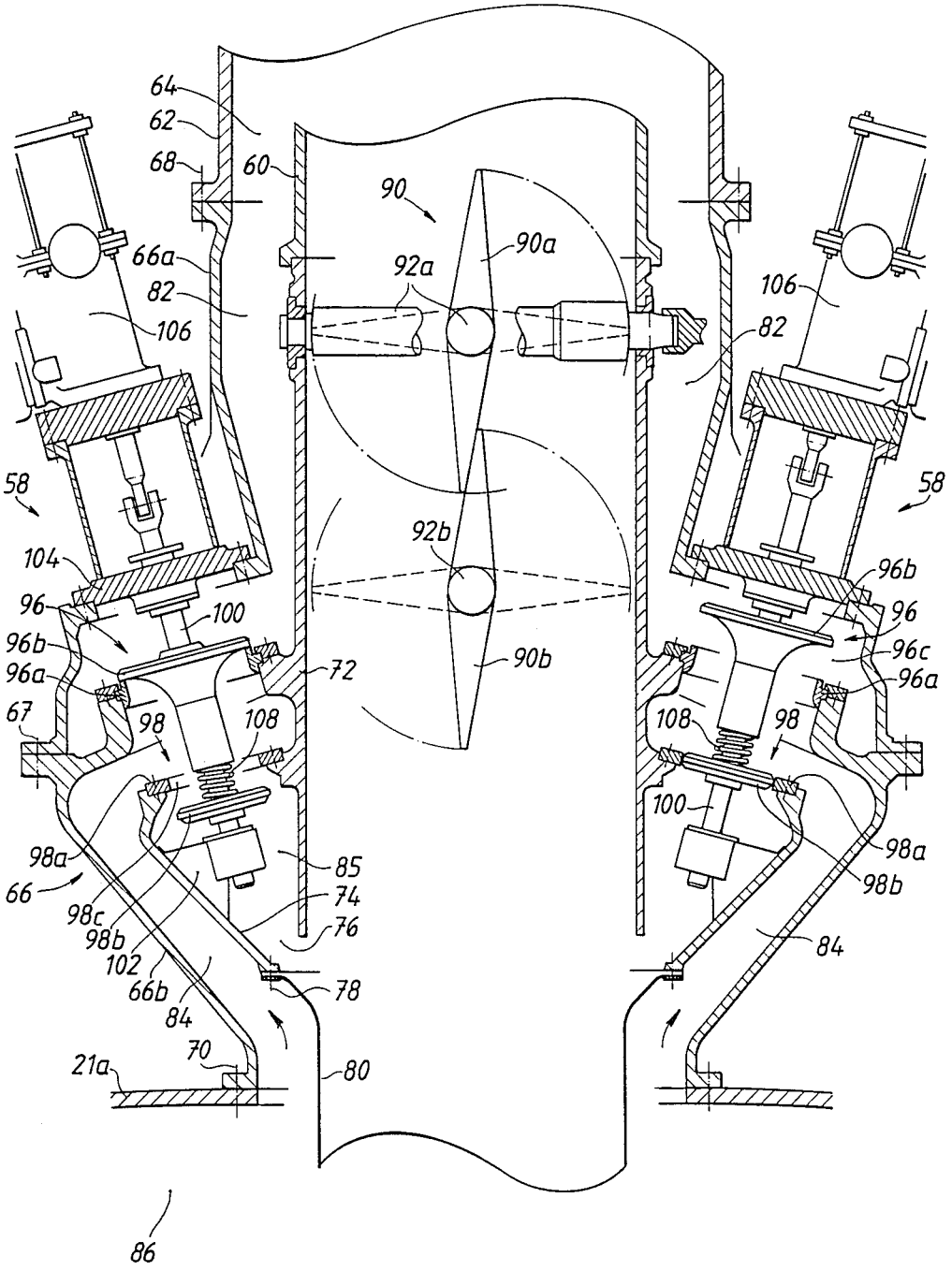
FIG. 3 is a section through the valve means according to the invention.

In FIGS. 1–3, 1 and 2 denote buildings containing a pressure vessel 3 with a bed vessel 4, and a turbine/compressor installation 5. The bed vessel 4 has a bottom 6 with nozzles 9 through which the bed vessel 4 is supplied with combustion air from the space 7 between bed vessel 4 and pressure vessel 3, as indicated by the arrows 8. The bed vessel 4 contains a bed 10 of particle material. Air flowing in through the nozzles 9 fluidizes the material in the bed 10 and burns the fuel supplied to the bed through the fuel pipe 11. A set of tubes 12 is provided in the bed vessel 4 to generate steam to drive a steam turbine, not shown, and cool the bed 10 so that the temperature is maintained at a level suitable for combustion, usually in the range of 800°–950° C. The combustion gases are collected in the space 13 above the bed 10 and are conducted through pipe 14 to a dust separation symbolized by a cyclone 15. Separated dust is withdrawn through the pressure-reducing feed-out means 16 in the form of a cooler. This may be placed in a shaft or channel 17 below the bottom 6 of the bed vessel 4, as shown in the drawings. The combustion air constitutes coolant and the heat is utilized to pre-heat the combustion air.

The combustion gases are conveyed ina pipe 20 to a gas turbine 21 which drives a compressor 22 and generator 23. In the compressor 22 compressed air is conveyed in pipe 24 to the space 7. Shut-off valves 25 and 26 are provided in pipes 20 and 24, respectively, and are operated by controls means 27 and 28, respectively. Between pipes 20 and 24 is a by-pass or short-circuit pipe 30 with a valve 31 operated by a control device 32. The pipe 30 is connected to pipes 20 and 24 between valve 25 and gas-turbine 21 and between valve 26 and compressor 22, respectively. A number of blow-off valves 33, 34 and 35 are connected to the air duct 24, and test valves 36, 37 and 38 in series therewith. These valves are operated in groups by a common control means 40 and 41, respectively, or by separate control devices. A silencer 39 for the blow-off air is provided on the building 2. Valves 33–35 may alternatively be connected directly to the pressure vessel or to the shaft 17 in such a manner that the ash cooler 16 is cooled by an air flow even during blow-off. The plant may be provided with an inert gas system, not shown, from which the pressure vessel and/or bed vessel can be supplied with inert gas during blow-off.

In the event of a disturbance in the gas-turbine/compressor part of the plant, for example if a turbine trips due to loss of load, valves 25 and 26 in pipes 20 and 24 will be closed and at the same time valve 31 in by-pass pipe 30 will be opened to give a short-circuit between compressor 22 and gas-turbine 21. Leakage of hot gas through the valve 25 cannot be prevented and thus a certain amount of energy is still supplied to the turbine 21.

If the disturbance cannot be rectified and normal operation resumed within a short time, the whole plant must be taken out of operation. Valve 25 in hot-gas pipe 20 is subjected to high temperature and complete sealing is impossible. A gradual pressure drop is obtained in the bed vessel due to leakage in the valve 25. At the same time air is blown off from the space 7, one or more of the valves 33–35 having been opened. The test valves 36–38 are normally open and are only closed when valves 33–35 are being function-tested or in the event of a fault in one of these valves.

The gas-turbine/compressor unit shown in FIG. 2 comprises gas turbine 21, compressor 22 and generator 23, which may also serve as start motor. The gas outlet 50 from the turbine 21 is connected through a pipe 52 to an exhaust boilder, not shown, where the residual heat in the gases leaving the turbine 21 is utilized. The valves 25, 26, 31 shown in FIG. 1 are combined in a single unit 58 directly joined to the gas-turbine housing 21*a*. This is provided in a manner not shown, with channels conducting combustion gases to the gas inlet of the turbine 21 and compressed air from the valve unit 58 of the compressor 22. As shown in FIGS. 2 and 3, the hot-gas pipe 20 from the dust separator 15 to the turbine and the pipe 24 for compressed combustion air from the compressor 21 to the pressure vessel 3 comprises two concentric pipes 60 and 62, respectively. Pipe 60 thus corresponds to pipe 20 and the gap 64 between pipes 60 and 62 corresponds to pipe 24.

As shown in FIG. 3, the valve unit 58 consists of a valve housing 66 composed of an upper part 66*a* and a lower part 66*b* with a bolted joint 67. The upper part 66*a* is connected to the pipe 62 by a bolted joint 68. The lower part 66*b* is connected to the turbine housing 21*a* by a bolted joint 70. Inside the housing is a cylinder 72, joined thereto and connected at the top to the pipe 60. The cylinder 72 is provided internally with an inner insulating layer, not shown. A part 74 of the lower part 66*b* of the housing 66 and the cylinder 72, forming a psace 76 between them. The part 74 is connected by a bolted joint 78 to a pipe 80 which is connected to the turbine inlet inside the turbine housing 21*a*. An annular gap 82 is formed between the upper part 66*a* of the valve housing and the cylinder 72 and a similar annular gap 84 between the lower part 66*b* of the valve housing and the part 74. The channel 84 and the cylinder 72 may communicate via the space 85 and gap 76. The outlet 88 from the compressor 22 is connected to the gas-turbine housing 21*a* and connects the compressor with channel 84 via space 86 in the turbine housing 21*a*.

The valves 90, 96, 98 corresponding to valves 25, 26, 31 in FIG. 1 are arranged in the valve unit 58. In the cylinder 72 is valve 90 with two valve discs 90*a* and 90*b* arranged in series, corresponding to valve 25. These valve discs are applied on shafts 92*a* and 92*b*, respectively, and can be turned 90°. It is impossible to obtain complete sealing against the cylinder 72 and there will therefore be a slight flow of gas after closing. The valve discs are operated by control means 94*a* and 94*b* as shown in FIG. 2.

Equivalents to valves 25 and 26 are arranged in the lower part 66*b* of the valve housing 66 and comprise a plurality, for example 2, 3 or 4, of valves 96 and 98, respectively, arranged in parallel, two being shown in FIG. 3. In the righthand side of the figure the valve 96 is shown open and the valve 98 closed, i.e. their positions during normal operation. In the lefthand side of the figure the valve 96 is shown closed and the valve 98 open, such as their positions in the event of a gas-turbine trip with short-circuiting of the compressor/gas-turbine. These valves 96, 98 having seats 96*a* and 98*a*, respectively, in the housing part 66*b*, and valve discs 96*b* and 98*b*, respectively, cooperating therewith and arranged on a common operating rod 100 journalled in bracket 102 and disc 104, respectively. This operating rod 100 is connected to an operating device 106 common for the two valves 96 and 98. The valve disc 96*b* is axially displaceable on the spindle 100 and is influenced in upward direction by a spring 108 to a normal position as shown in FIG. 3. The valve disc 98*b* is permanently secured to the spindle 100.

When the PFBC power plant is in operation valve 90 will be open and the valve discs 90*a* and 90*b* in the position shown in FIG. 3. Propellant gas from the bed vessel 4 flows through pipe 90, corresponding to pipe 20 in the schematically drawn FIG. 1, cylinder 72 and pipe 80 to the turbine inlet. Compressed combustion air from the compressor 2 flows through space 86 into the turbine housing 21*a*, gap 84, opening 96*c* in the valve 96, gap 82 and gap 64 between pipes 60 and 62, to the pressure vessel 3 and from this to the bed vessel 4. See the righthand part of FIG. 3.

In the event of a gas-turbine trip, the valve discs 90*a* and 90*b* will be turned 90°, thus closing valve 90. At the same time valves 96 will be moved from open to closed position and valves 98 from closed to open position by means of their common operating device 106, i.e. valve discs 96*a* and 98*a* are moved from the position shown in the righthand part of FIG. 3 to that shown in the lefthand part. The flow of propellant gas through valve 90 is reduced to leakage flow. Compressed combustion air from compressor 22 flows through space 86, gap 84, valve opening 98*c* in valves 98, space 85, gap 76 and pipe 80, directly to the turbine, together with leakage gas passing through valve 90 which is not fully sealed. The energy supply from the bed vessel 4 ceases substantially entirely and the turbine is prevented from racing when generator 23 is disconnected and the load thus suddenly drops. Closing valves 96 prevent compressed combustion air in the pressure vessel 3 from flowing back and constituting propellant gas for the turbine.

The provision of several valves 96 and 98 in parallel, and an axially movable valve disc 96*b* on spindle 100, ensures good security against faults of an operating device which would entail failure of the operation movement. In the event of one control device 106 not functioning, the associated valve 96 will in any way close. Closing of the valves 96 and opening of valves 98 in the short circuit connection 85 operated by the functioning operating devices 106 gives a rapid and considerable pressure drop in channel 84. A considerable pressure difference is obtained between channel 82 and channel 84 and thus on each side of the valve disc **96*b*. The force obtained exceeds the force of the spring 108 and displaces valve disc 96*b* downwards to cooperate with valve seat 96*a*, thus closing the valve opening 96*c*. Valve 98 remains closes. The fact that one valve 98 out of four does not open tanils no great risk, but merely the resistance in the short-circuit connection between compressor 52 and turbine 50 increases somewhat. Besides providing increased safety, the division of valve unit 58 into two valve functions with a plurality of valve units 96 and 98 arranged in parallel also means that the valve unit 58** can be made very compact and thus requires little space.

We claim:

1. A power plant comprising:

a combustion chamber for burning fuel at a pressure exceeding atmospheric pressure;

a gas turbine driven by the combustion gases generated;

a compressor driven by the gas turbine for compression of combustion air;

a first gas conduit for conveying combustion gases from the combustion chamber to the turbine;

a second gas conduit for conveying combustion air from the compressor to the combustion chamber; and a single valve unit in communication with the first and second gas conduits, the valve unit including;

a valve unit housing;

a through-cylinder located centrally therein and connected to the first gas conduit;

at least one first shut-off valve provided in the cylinder;

a channel formed between the valve unit housing and the cylinder, arranged around the cylinder, and extending through the valve unit housing, the channel being connected to the second gas conduit;

a plurality of second shut-off valves arranged parallel in the channel;

a communication means between the channel and the cylinder constituting a short circuit connection between the compressor and the turbine; and a plurality of third valves arranged in the communication means.

2. A power plant comprising:

a combustion chamber for burning fuel at a pressure exceeding atmospheric pressure;

a gas turbine driven by the combustion gases generated;

compressor driven by the gas turbine for compression of combustion air;

a first gas conduit for conveying combustion gases from the combustion chamber to the turbine;

a second gas conduit for conveying combustion air from the compressor to the combustion chamber; and a single unit including:

a valve housing;

a cylinder extending through the valve housing and connected to the first gas conduit;

at least one first valve located in the cylinder;

a plurality of channels arranged around the cylinder;

a second valve in each of the plurality of channels;

a communication means between each of the channels and the cylinder constituting a short-circuit connection; and a third valve in each of the communication means.

3. A power plant as claimed in claim 1, wherein the second valves in the channel arranged around the cylinder and the third valves in the communication means between the channel and the cylinder are provided with valve discs arranged on a common spindle and operated by a common operating device.

4. A power plant as claimed in claim 3, wherein the valve discs in the second valves in the channel are axially displaceable on the spindle and are influenced in one direction by a spring which retains the valve discs in a normal position with respect to the spindle.

5. A power plant as claimed in claim 2, wherein the second valves in the channels arranged about the cylinder and the third valves in the communications between the channels and the cylinder are provided with discs arranged on a common spindle and operated by a common operating device.

6. A power plant as claimed in claim 5, wherein the valve discs in the second valves in the channels are axially displaceable on the spindle and are influenced in one direction by a spring which retains the valve discs in a normal position with respect to the spindle.

* * * * *